US005329744A

United States Patent [19]

Sumter

[11] Patent Number: 5,329,744

[45] Date of Patent: Jul. 19, 1994

[54] HANDY T

[76] Inventor: Steven M. Sumter, 1916 W. Poplar St., Philadelphia, Pa. 19130

[21] Appl. No.: 863,058

[22] Filed: Apr. 3, 1992

[51] Int. Cl.[5] ..... E04D 15/00

[52] U.S. Cl. ..... 52/749; 52/632

[58] Field of Search ..... 52/749, 632; 248/354.5, 248/351, 354.4, 554.1, 355; 182/178, 179

[56] References Cited

U.S. PATENT DOCUMENTS

| | | | |
|---|---|---|---|
| 1,762,397 | 6/1930 | Kinser | 254/6 C |
| 1,848,094 | 10/1958 | Olson | 248/355 |
| 2,907,598 | 10/1959 | Hart | 248/355 |
| 3,131,928 | 5/1964 | Whipple | 214/1 SW |
| 3,827,665 | 8/1974 | Kistler | 52/532 |
| 3,930,645 | 1/1976 | Anderson | 248/355 |
| 4,083,156 | 4/1978 | Tye | 52/749 |
| 4,120,484 | 10/1978 | Zimmer | 214/1 SW |
| 4,300,751 | 11/1981 | Delaney | 254/2 R |
| 4,339,219 | 7/1982 | Lay | 254/4 C |
| 4,559,747 | 12/1985 | Engel | 52/632 |
| 4,576,354 | 3/1986 | Blessing | 52/749 |
| 4,600,348 | 7/1986 | Pettit | 52/632 |

*Primary Examiner*—Carl D. Friedman
*Assistant Examiner*—Beth H. Aubrey

[57] ABSTRACT

A gypsum board support device with two opposite right angle locking support arms attached to an adjustable standard used temporarily when mounting gypsum board to ceiling members.

The standard is of knockdown construction for ease in transporting to various construction sites.

2 Claims, 6 Drawing Sheets

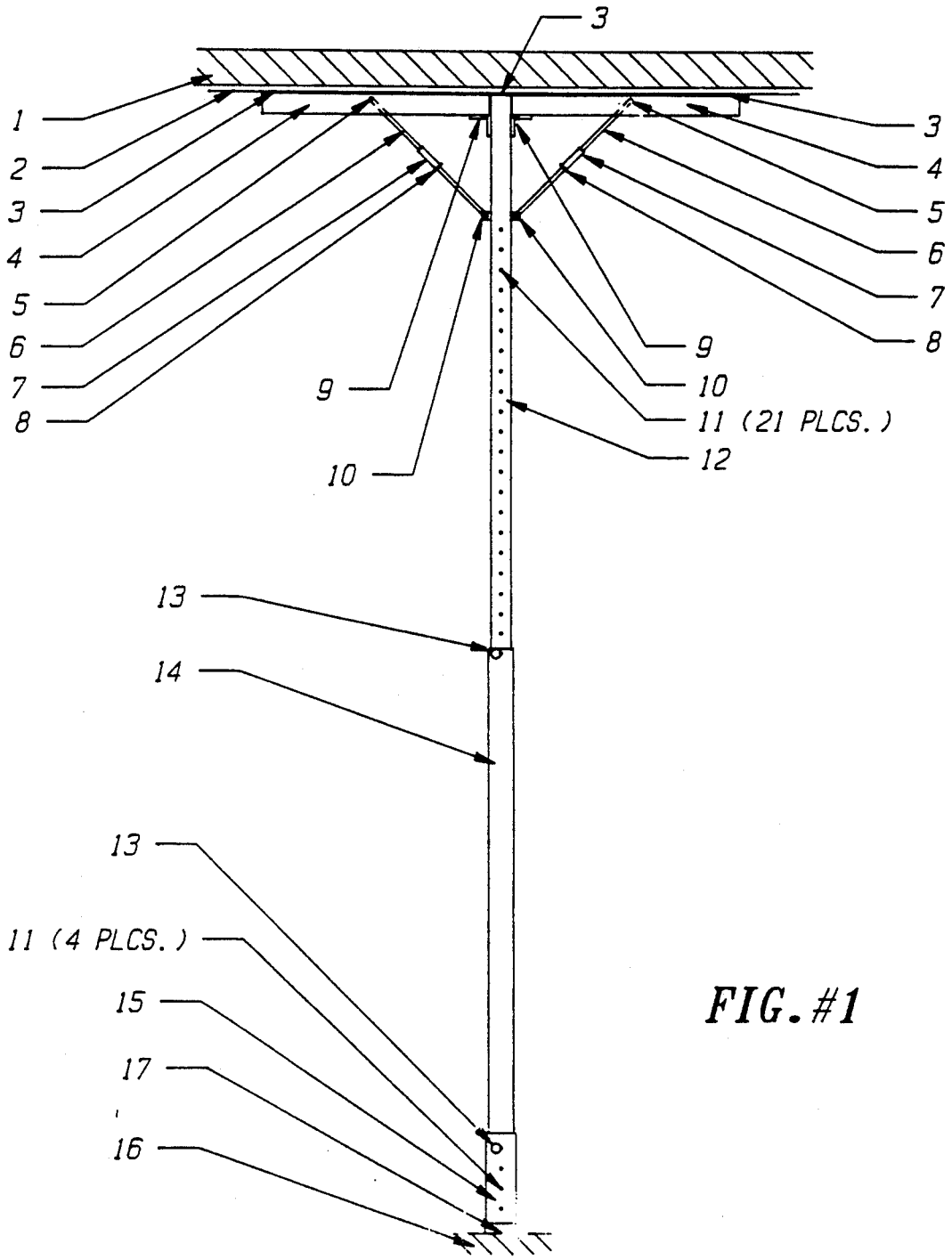
FIG. #1

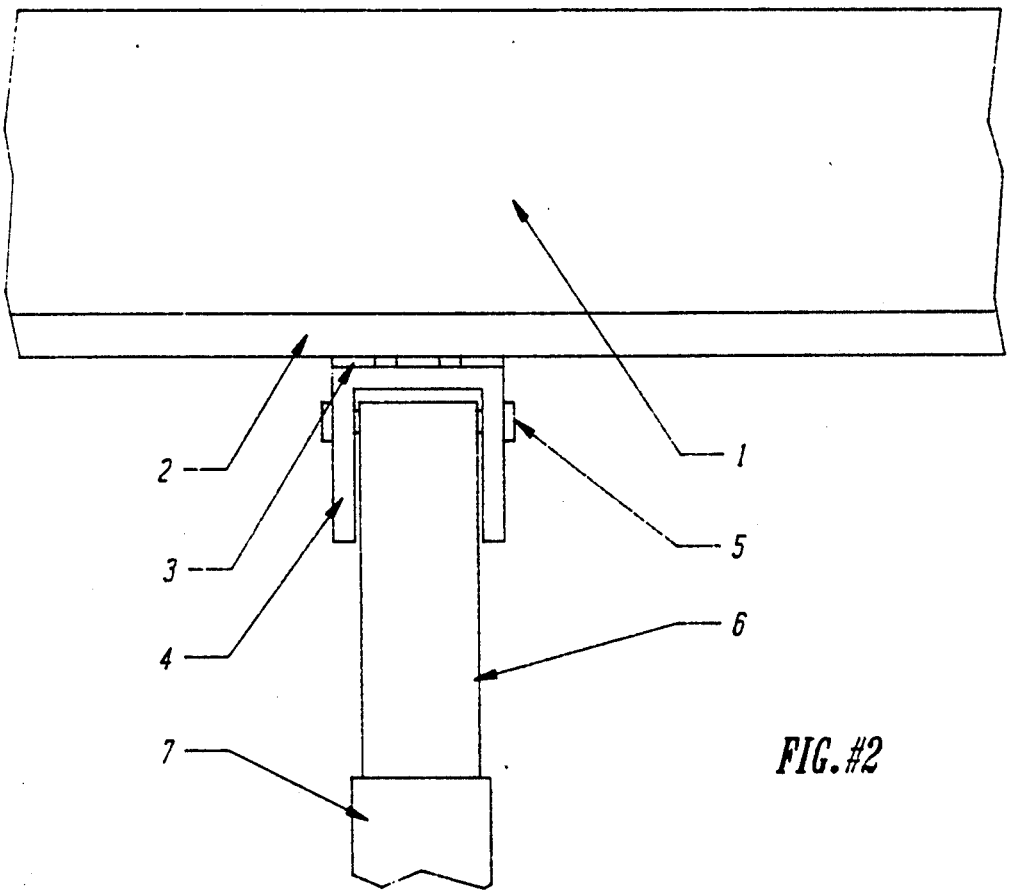
FIG. #2

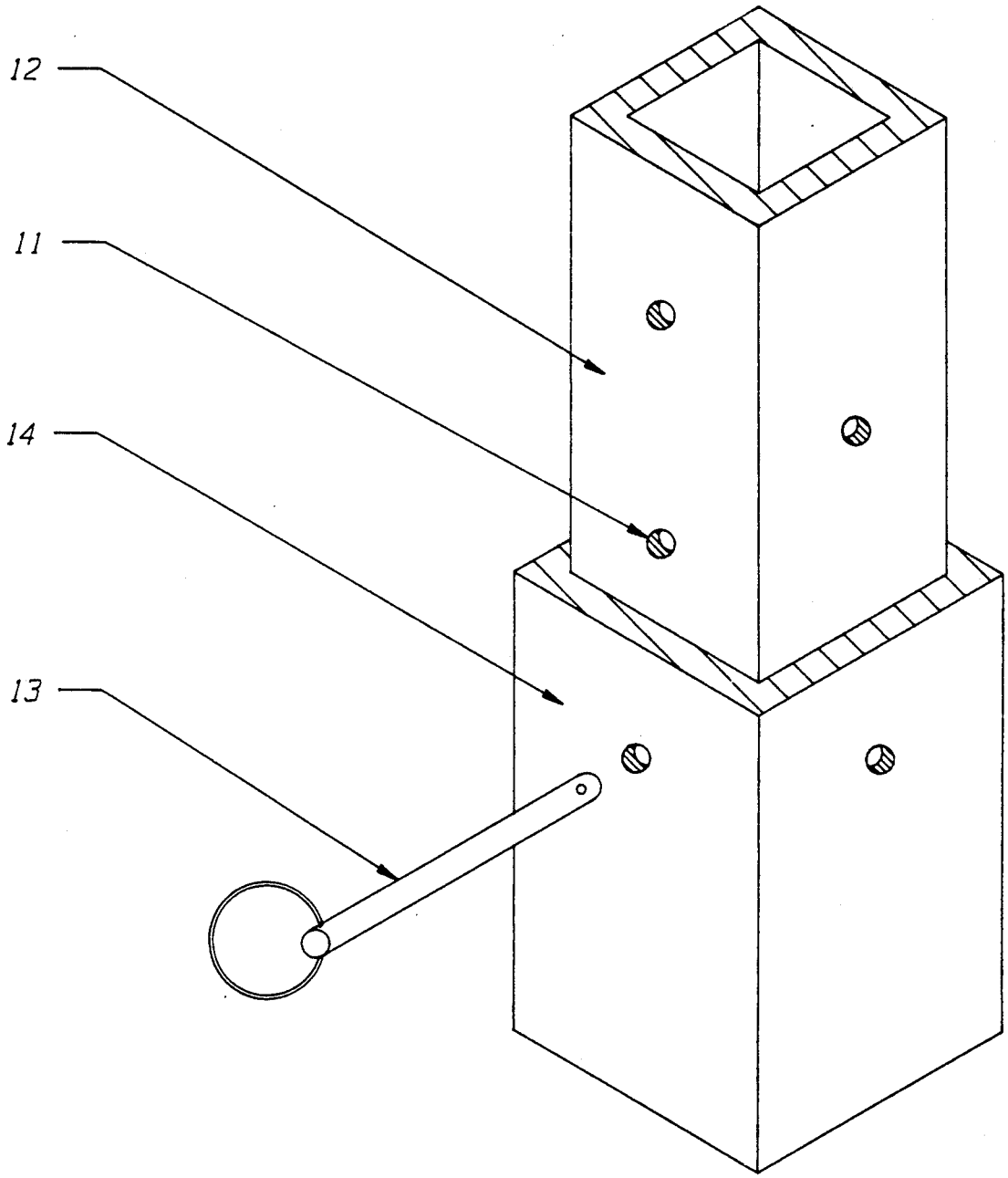
FIG. #3

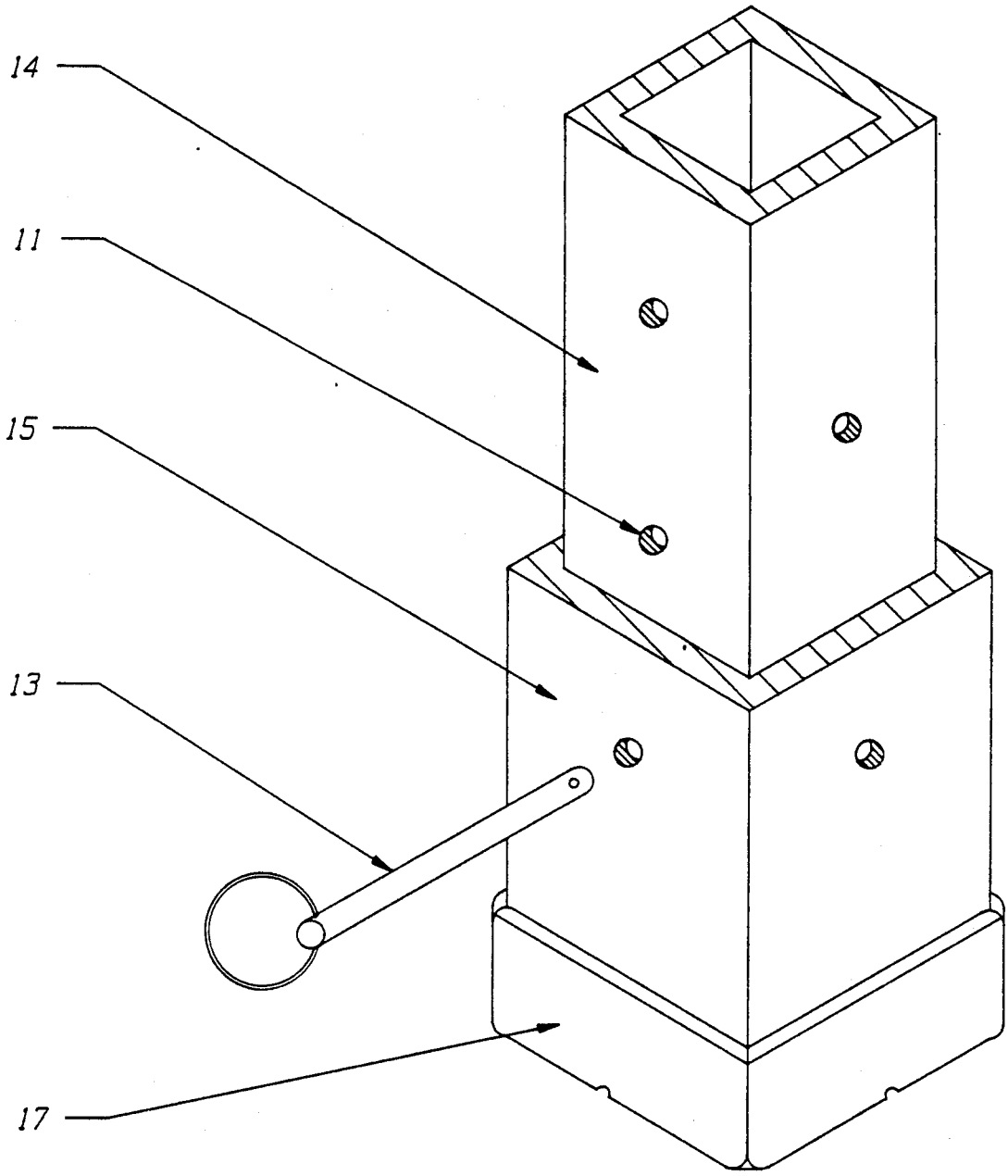
FIG. #4

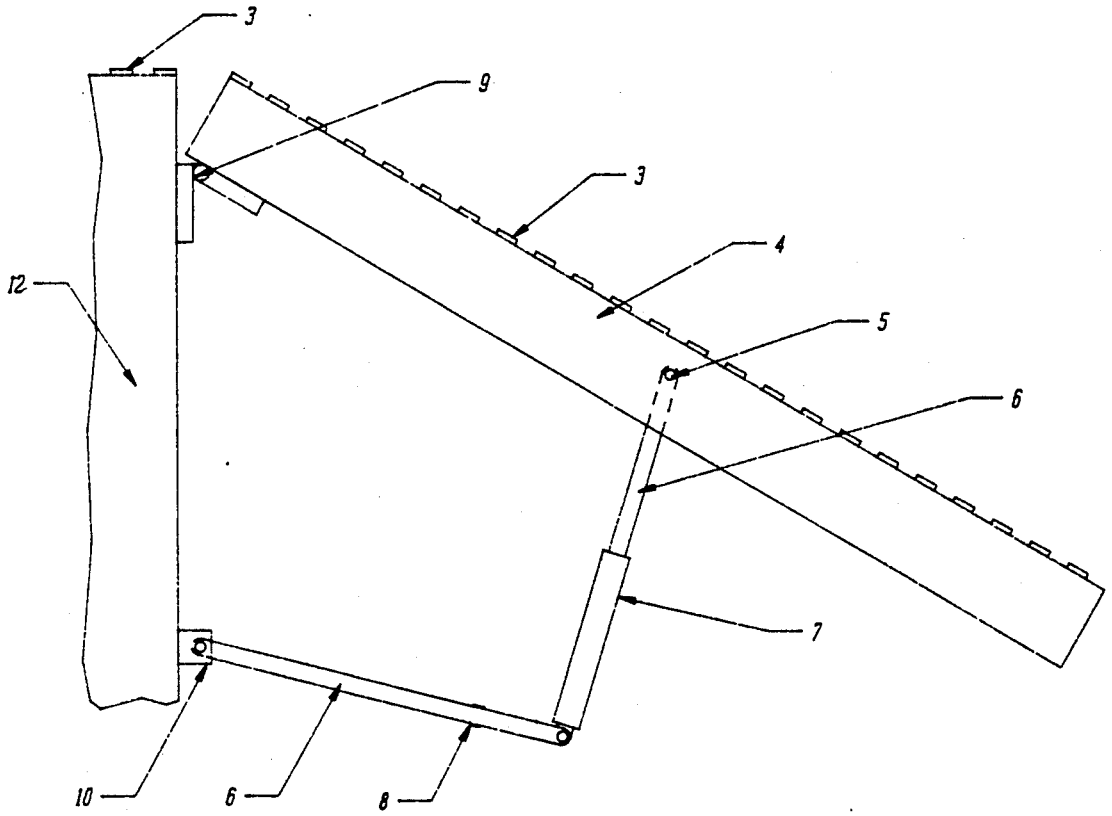
FIG. #5

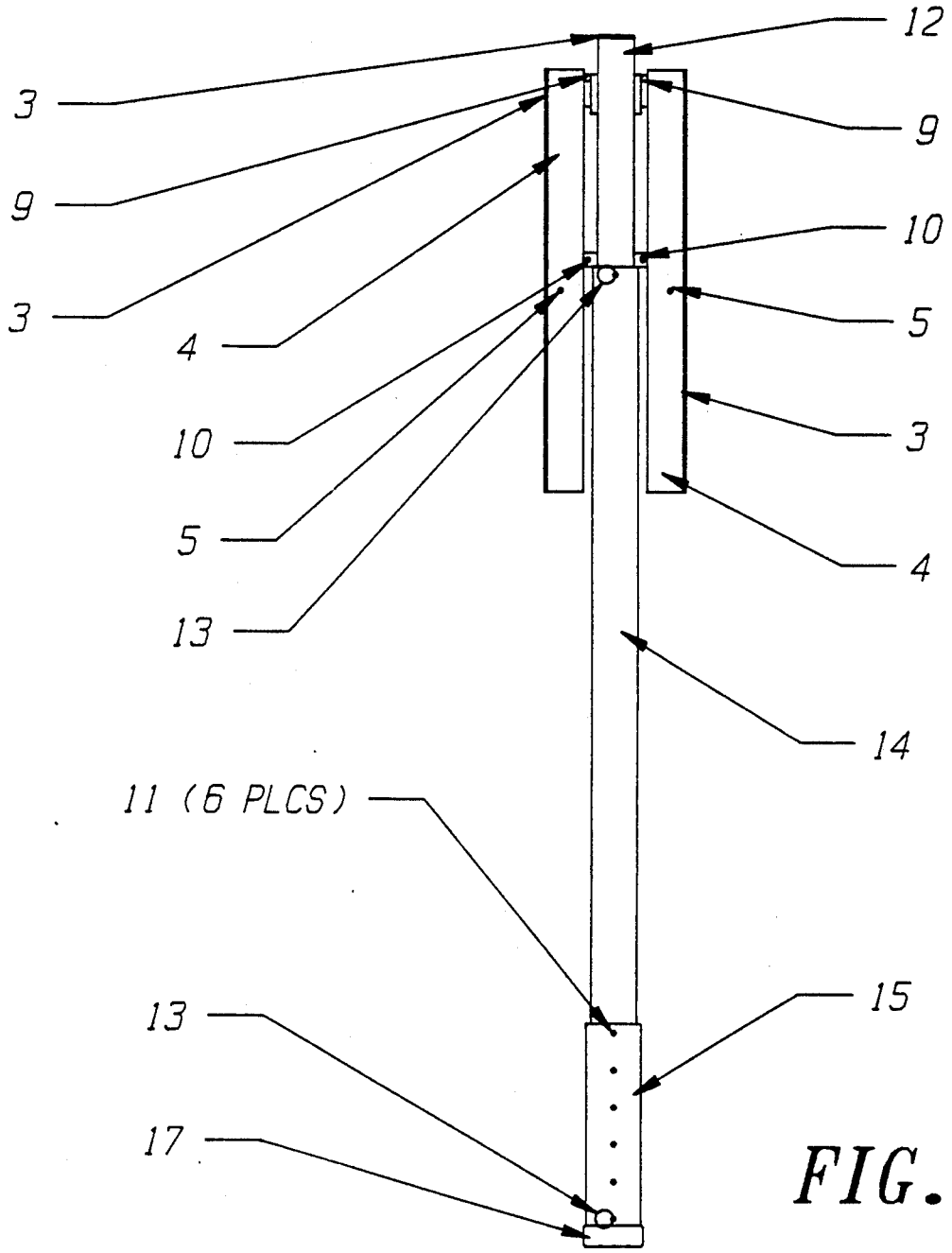
FIG. #6

HANDY T

BACKGROUND OF THE INVENTION

The purpose of the "Handy T" is to assist one (1) or two (2) persons in the installation of ⅜", ½" and ⅝" gypsum board to ceilings as a temporary support devise during installation only and until permanent attachment to ceiling members can be made.

The "Handy T" can be made of several materials, not limited to steel, fiberglass and aluminum. It will function with two (2) detachable vertical hinges attached to the Upper In-Line Support Beam with all upper connecting points to the Right/Left Support Arm Hinge being detachable. This feature was added to allow the user to exchange the 21½" support arms for a longer size support arm.

The Extension Safety Overlap will prevent damage to the Support Arm Hinges when the machine is being closed.

The Support Spring and Load Bearing Support Pin are designed with such tension that they can easily be depressed with minimal force. They are used to lock the machine at varying heights.

The inner chamber of the unit has a Guide Track System designed to allow the Upper In-Line Support Beam smooth retraction into the Lower In-Line Support Chamber. The Upper and Lower In-Line Support Beams also have a Safety Extension Bar which helps to stabilize the Upper and Lower Beams when they are in their fully extended position.

The Height Adjustment Holes allow the Spring and Pin System to lock in place at varying heights.

The Lower Support Chamber shall house the Upper In-Line Support Beam and the Lower In-Line Support Beam. The Lower In-Line Support Beam will also function with a Spring and Pin System allowing for further height adjustments at one inch increments.

The Lower In-Line Support Beam shall be attached to the Rubber Grip and Support Shoe, which will help prevent the machine from slipping.

SUMMARY OF THE "HANDY T"

The gypsum board (2) being held in position snugly to the ceiling member (1) by the Rubber Grips (3) which is embedded into the Right/Left Support Arm (4) at intervals of approximately one (1) inch apart. 4 being connected to, but not permanently attached to the Support Arm Hinge (9), allowing 4 to extend to a full right angle or collapse to a straight angle. 4 also being connected to, but not permanently attached to the Right/Left Upper Arm Support Hinge System (5,6,7,8). 5,6,7,8 being permanently connected to the Upper In-Line Support Beam (12). 5,6,7,8 is protected from damage upon full collapse by the Extension Safety Overlap (10). The Lower In-Line Support Chamber (14) shall house 12, when 12 is fully retracted. 12, being kept in the erect position by the Upper and Lower Load Bearing Support Pin and Support Spring (13). 13, being a tension loaded spring system made to retract upon manual compression. Height Adjustment Holes (11) are placed in 14 and 12 approximately three and one-half inches (3½") apart to provide for manual height adjustments. The Shoe Height Adjustment Holes (11) allow for further manual adjustments to the Lower In-Line Support Beam (15) of one (1) inch increments. The Rubber Grip and Support Shoe (17) is attached to 15 to help prevent skidding of the machine when wedged to the floor member (16).

DESCRIPTION OF THE DRAWINGS

FIG. 1 shows the extended view of the machine supporting a piece of gypsum board against a ceiling.

FIG. 2 shows an end view of the machine supporting a sheet of gypsum board.

FIG. 3 shows the connection of the upper extension and the lower support chamber.

FIG. 4 shows the connection of the lower support chamber and the shoe extension.

FIG. 5 shows a support arm in its partially shut position.

FIG. 6 shows the machine in its fully closed position ready for transportation.

DESCRIPTION

1. CEILING MEMBER
2. GYPSUM BOARD
3. RUBBER GRIPS
4. RIGHT/LEFT SUPPORT ARM - CONNECTS TO THE ARM HINGE
5,6,7,8. RIGHT/LEFT UPPER ARM SUPPORT HINGE SYSTEM - HINGE DESIGNED TO HOLD SUPPORT ARMS AT RIGHT ANGLE AND IS DETACHABLE
9. RIGHT/LEFT SUPPORT ARM HINGE - CONNECTS TO UPPER SUPPORT BEAM
NOTE: HINGE SIZE WILL VARY DEPENDING ON MACHINE AND IS DETACHABLE
10. EXTENSION SAFETY OVERLAP
11. HEIGHT ADJUSTMENT HOLES/SHOE ADJUSTMENT HOLES
12. UPPER IN-LINE SUPPORT BEAM
13. UPPER AND LOWER LOAD BEARING SUPPORT PIN AND SPRING SYSTEM
14. LOWER SUPPORT CHAMBER
15. LOWER IN-LINE SUPPORT BEAM
16. FLOOR MEMBER
17. RUBBER GRIP AND SUPPORT SHOE

I claim:

1. A device for temporarily supporting gypsum boards on ceiling members during installation, said device comprising:

first and second pivoting arms having upper and lower surfaces, each said arm having rows of friction grips attached to said upper surface to firmly hold the gypsum boards;

an upper support column having holes spaced at equal increments for height adjustments;

first and second hinges attaching said first and second arms to said upper support column;

first and second braces each having pivotable first and second members, said braces supporting the pivoting arms, and a cover locking the first and second arms in a locked open position;

a safety overlap device attached to the upper support column preventing damage to the braces upon closure;

a lower support column having a top and bottom, said lower support column slidably receiving said upper support column, said lower support column having holes spaced at equal increments; and a first and second pin means comprising a spring and a metal pin, said first pin means connecting said upper and lower support columns by passing through aligned holes in said upper and lower support columns.

2. The device of claim 1, said lower support column hole spacing having a smaller increment than said upper support column hole spacing; and a rubber non-skid shoe attached to the bottom of said lower support column supporting said device thereon, said second pin system connecting said lower support column and slidably received in said shoe.

* * * * *